US005375499A

United States Patent [19]

Leonard

[11] Patent Number: 5,375,499

[45] Date of Patent: Dec. 27, 1994

[54] SINGLE TRIGGER PERFECT FIFTH SLIDE BASS TROMBONE

[75] Inventor: B. P. Leonard, Akron, Ohio

[73] Assignee: The University of Akron, Akron, Ohio

[21] Appl. No.: 64,961

[22] Filed: May 18, 1993

[51] Int. Cl.[5] ..... G10D 7/10

[52] U.S. Cl. ..... 84/395

[58] Field of Search ..... 84/393, 394, 395, 396, 84/453

[56] References Cited

U.S. PATENT DOCUMENTS

| | | | |
|---|---|---|---|
| 468,116 | 2/1892 | Robinson | 84/395 |
| 2,027,340 | 1/1936 | Holton | 84/395 |
| 2,093,993 | 9/1937 | Adriani | 84/395 |
| 3,631,755 | 1/1972 | Giantz et al. | 84/388 |
| 3,903,779 | 9/1975 | McCracken | 84/395 |
| 4,213,371 | 7/1980 | Thayer | 84/396 X |
| 4,273,020 | 6/1981 | Happe | 84/394 |
| 4,831,911 | 5/1989 | Wanner | 84/395 |
| 4,993,303 | 2/1991 | Clark | 84/394 |

FOREIGN PATENT DOCUMENTS

| | | |
|---|---|---|
| 1293357 | 4/1962 | France . |
| 424455 | 5/1991 | France . |
| 1003389 | 9/1965 | United Kingdom . |

OTHER PUBLICATIONS

"Declaration for the Purpose of Disclosing Prior Art Sale"–by B. P. Leonard dated May 18, 1993.

*Primary Examiner*—Michael L. Gellner
*Assistant Examiner*—Patrick J. Stanzione
*Attorney, Agent, or Firm*—Hudak & Shunk Co.

[57] ABSTRACT

A slide trombone is provided which has an attachment that is activated by a single thumb trigger to lower the basic pitch of the trombone by a perfect fifth. This attachment configuration permits the player to play all the chromatic tones between the tenor range and the pedal notes using a standard length slide.

13 Claims, 3 Drawing Sheets

Bb/F
Bb4
F4
D4
C4
Bb3
A3
F3
C3
Bb2
F2
Bb1
F1
VIII
VII
VI
V
IV
III
II
I
(0)
(0)
TONES OF THE CHROMATIC SCALE
1st
2nd
3rd
4th
5th
6th
7th
SLIDE POSITION

Bb/Eb
Bb4
F4
D4
C4
Bb3
G3
F3
Eb3
Bb2
Eb2
Bb1
Eb1
VIII
VII
VI
V
IV
III
II
I
TONES OF THE CHROMATIC SCALE
1st
2nd
3rd
4th
5th
6th
7th
SLIDE POSITION

SINGLE TRIGGER PERFECT FIFTH SLIDE BASS TROMBONE

FIELD OF INVENTION

The present invention relates to trombones, and more particularly to a slide bass trombone having an attachment lowering the pitch by a perfect fifth. The basic pitch could be B♭ or C (with the attachments in E♭ or F, respectively).

DESCRIPTION OF THE PRIOR ART

The slide trombone is a brass wind instrument which relies on varying the length of tubing through which air passes to vary the pitch of the resulting sound. Generally, a slide trombone player will vary the length of tube and the resulting sound pitch by selectively telescoping the trombone slide relative to the bell portion of the trombone.

The conventional trombone has a mouthpiece mounted on a fixed length of straight tubing. The mouthpiece is connected to a bell from which the sound emanates when the instrument is played by means of an adjustable slide section. A second fixed length of straight tubing is coupled on one end through a U-shaped section of tubing to the bell. The free end of each of the fixed lengths of tubing, or receivers, terminates in a raised angular section or lip called a stocking. A U-shaped section of tubing forming a "slide" provides two leg portions, each having an inner diameter slightly greater than the outer diameter of the stockings of the fixed length straight members of the tubing. The slide is slidably mounted on the two fixed-length straight tube members by slipping the slide legs over the inner tube stockings. Lubricant is applied to the stockings before the instrument is played and permits the slide to ride freely along the inner tube members by varying the length of the tubing through which air travels between the mouthpiece and the bell of the trombone. Extending the tube length of the instrument by a slide rather than by valves, permits a continuous, rather than discrete change in pitch, which provides a sound unique to the trombone as compared to other wind instruments.

Prior to 1839, the tone sounded by trombones was generally achieved by changing the embouchure and the slide position. In 1839, a thumb-actuated valve was invented by Sattler, in Leipsig. At the time of the invention of this thumb-actuated valve, a nominal trombone section consisted of an alto in E♭, a tenor in B♭, and a bass in F (i.e., a grouping in perfect fourths). Thus, it was logical to combine the two traditional B♭ and F instruments into a single design by adding an F attachment to the standard B♭ trombone. Accordingly, it is now quite common for B♭ trombones to include an F attachment. This trombone is illustrated in FIG. 2.

Unfortunately, the standard length B♭ (seven position) slide is not quite long enough to accommodate a true low C (with the attachment actuated), although professional players compensate for this deficiency by embouchure adjustment. The low B# (played in the seventh position on the large F bass trombone), is missing on the B♭/-F combination.

When the B♭/F instrument is used as a bass trombone, various strategies have been devised to accommodate the low B#. Prior to the 1960's, this usually involved the "E pull" tuning slide within the F loop. Playing technique requires identification of passages involving the low B# ahead of time, then, during an appropriate rest in the music, manually extending the tuning slide from F to E#, negotiating the particular passage using different slide positions and using embouchure adjustment for the otherwise quite sharp B#; then during another rest, returning the tuning slide to F for remaining passages not containing the low B#. In the 1960's, a second valve also operated by the left thumb in an awkward rolling sliding motion was available in some commercial designs. This is sometimes referred to as a side-by-side trigger. The second trigger actuates additional tubing within the F loop, instantly converting it to an E# attachment. While the playing technique of this design is less cumbersome, the low B# still requires considerable embouchure adjustment just as in the E-pull technique. Modern tuning of the second attachment in E♭ or D are available which provides for the low B# in a closer position; however, this design still requires the awkward thumb motion.

Also during the mid 1960's, the concept of an "in-line" independently actuated dual trigger double valve design appeared. The first commercial design manufactured by Alexander (the so-called "Cimbasso" instrument), was designed by Kunitz in 1963. A further example of this is shown in French Patent No. 1,293,357. However, this design was not applied to the B♭ instrument, but rather to a large F bass trombone. The thumb attachment lowers the tuning by a perfect fourth to C, the independent middle finger attachment lowers the pitch by a minor third to D, and the two actuated together put the instrument in a low B♭, thereby producing a true contra-bass trombone with a complete chromatic range and an abundance of alternate positions in the low register. However, the size and weight of this instrument calls for considerable physical endurance on the part of the player. The same principles have been applied to the B♭ bass trombone, producing a B♭/F/G/E♭ or alternatively B♭/F/G♭/D design in which the "traditional" F attachment is operated by the left thumb, and the finger trigger is tuned to either G# or G♭ and the two together produce E♭ or D, respectively. Although this design provides a solution to the missing note, the positions with the more often used thumb trigger activated F attachment are no more convenient than for the single trigger F attachment design.

It is an aspect the present invention to provide a slide trombone having thumb-activated single-trigger perfect fifth attachment. With a conventional length slide having seven tone positions in B♭, there are five positions available with the attachment activated. The attachment tones available thereby completely fill in the five missing tones between the tenor-range and the pedal notes of the B♭ configuration. Two types of embodiments are presented: in the first, with the trigger unactivated, the instrument is in B♭/or C, actuation of the trigger then adds the additional tubing to lower the pitch to E♭ or F respectively, in the second embodiment, the trigger action is reversed.

DETAILED DESCRIPTION OF THE INVENTION

Figure 1:
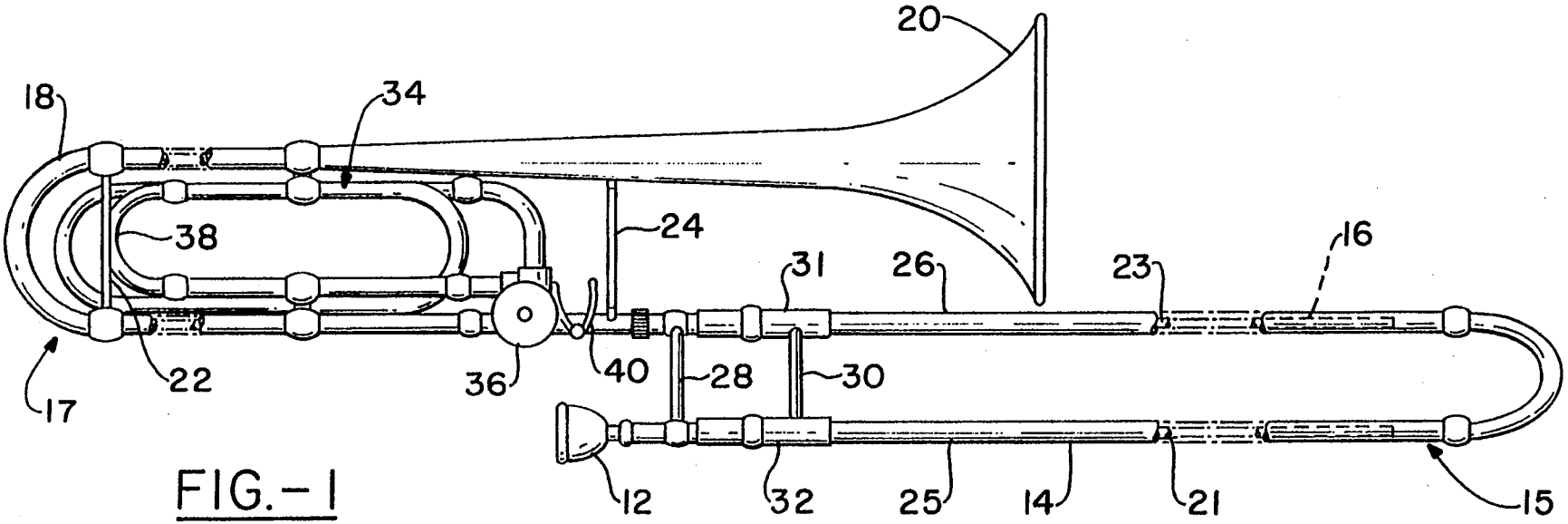
FIG. 1 is a drawing of a single trigger major fifth tenor trombone in accordance with the invention.
Figure 2:
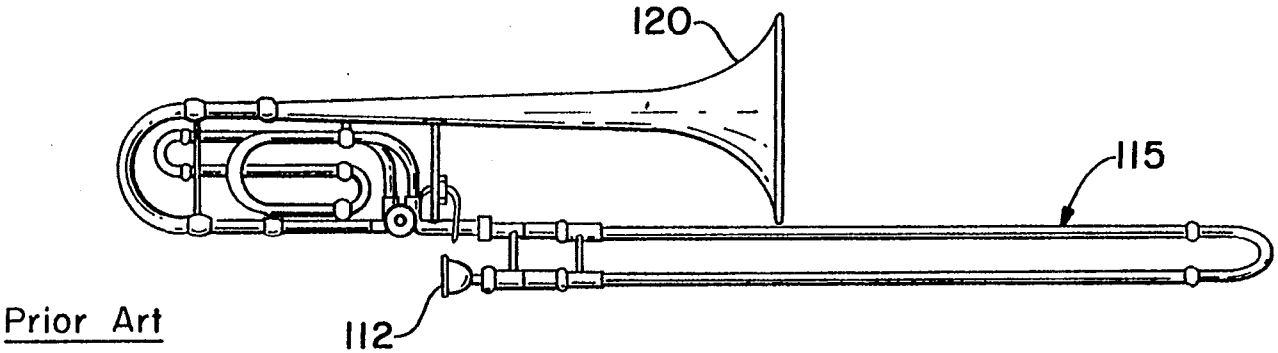
Prior Art FIG.-2
FIG. 2 is a drawing of a conventional B♭/F trombone in accordance with the prior art.

FIG. 1 shows a single trigger major fifth attachment trombone in accordance with the present invention. The trombone includes a basic windpath which comprises a slide assembly 15, a tuning loop 17, a mouthpiece 12, and a bell 20. The slide assembly 15 includes an inner slide 16 which has two generally parallel inner tubes, 21, 23. One inner tube 21 is joined to the mouthpiece 12, while the other inner tube 28 is joined to the tuning loop 17.

The slide assembly 15 also includes a generally U-shaped outer slide 14, which includes two generally parallel outer tube members 25, 26, which are in telescoping engagement with the inner tubes 21, 23 of the slide assembly. The outer slide 14 glides along the inner slide 16 to lengthen the length of the windpath and lower the pitch of the trombone accordingly. The pitch of the trombone will depend upon the length of the windpath. Generally speaking, a lower pitch results from a longer path, however, it should be understood that a trombone will resonate at multiple harmonic frequencies for the same length of windpath, the fundamental pitch being the lowest available note for a given windpath. The player selects a given harmonic or tone by adjusting his or her embouchure. The slide position will determine a note selection for any given harmonic. As used herein, basic pitch refers to the fundamental pitch which is produced when the slide is in a closed position.

The tuning loop 17 extends from its joint connecting it with the inner slide 16 and has two generally parallel tube portions joined by a tuning bow 18. The tuning bow 18 can be adjusted in and out in order to tune the trombone to a specific frequency. The tuning loop terminates in a bell 20. The loop is stabilized by a tuning slide brace 22 which can optionally include a counter weight to help balance the weight of the slide assembly as the slide is slid from first position outward. The tuning loop further includes a bell brace 24 which can be positioned in front of or behind the hand of the user which bears the weight of the trombone. The slide assembly includes first and second transfer braces 28 and 30 which help stabilize the inner and outer slides, respectively.

The inner slide 16 includes sleeves 31, 32, which receive the outer slide 14 when it is in a closed position. Generally, the sleeves 31, 32 include a positive stop for the outer slide which can include a spring loaded bumper as is known in the art.

Figure 3:
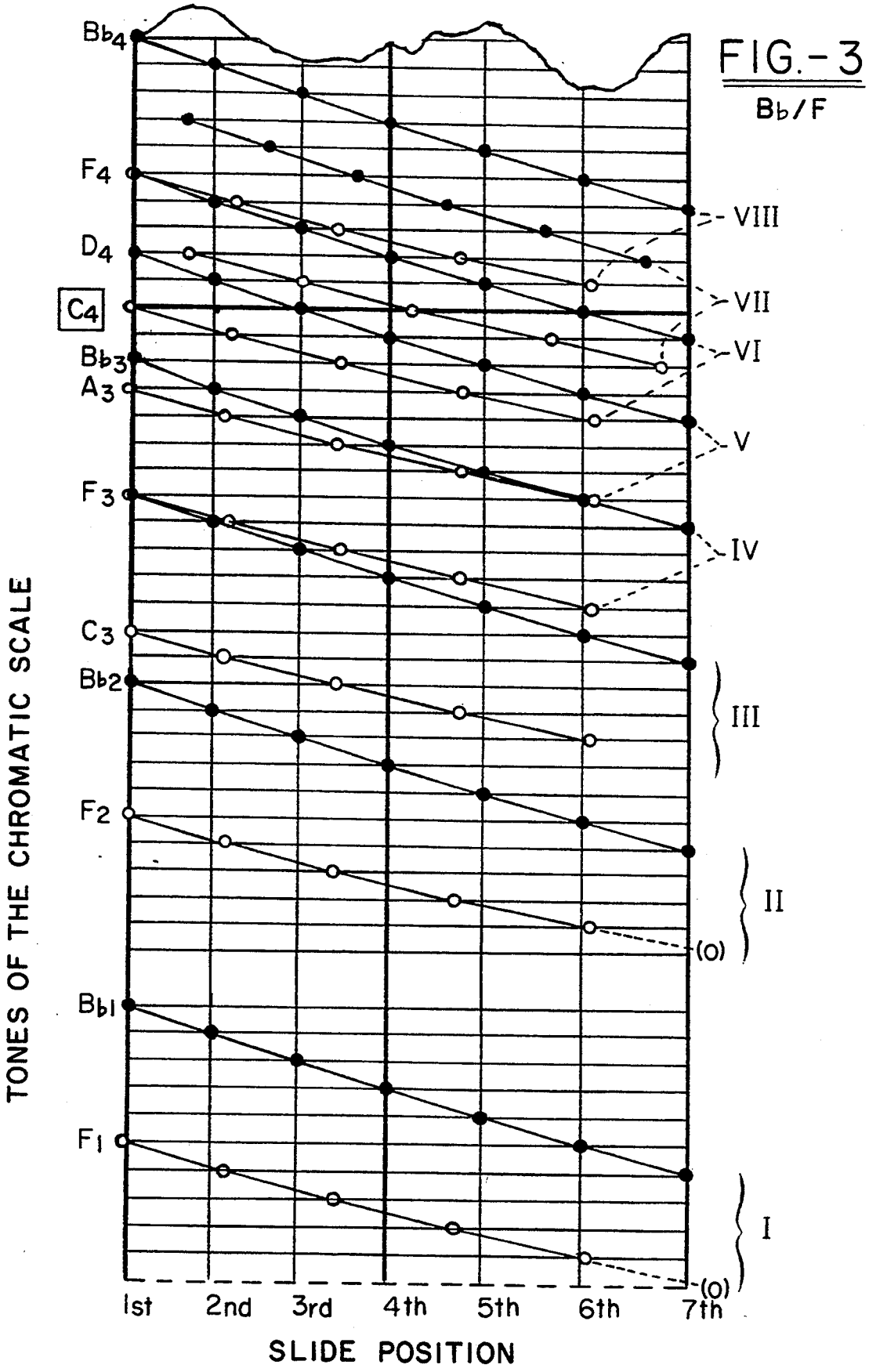
FIG. 3 is a tone/slide-position chart for a standard B♭/F trombone in accordance with the present invention.
Figure 4:
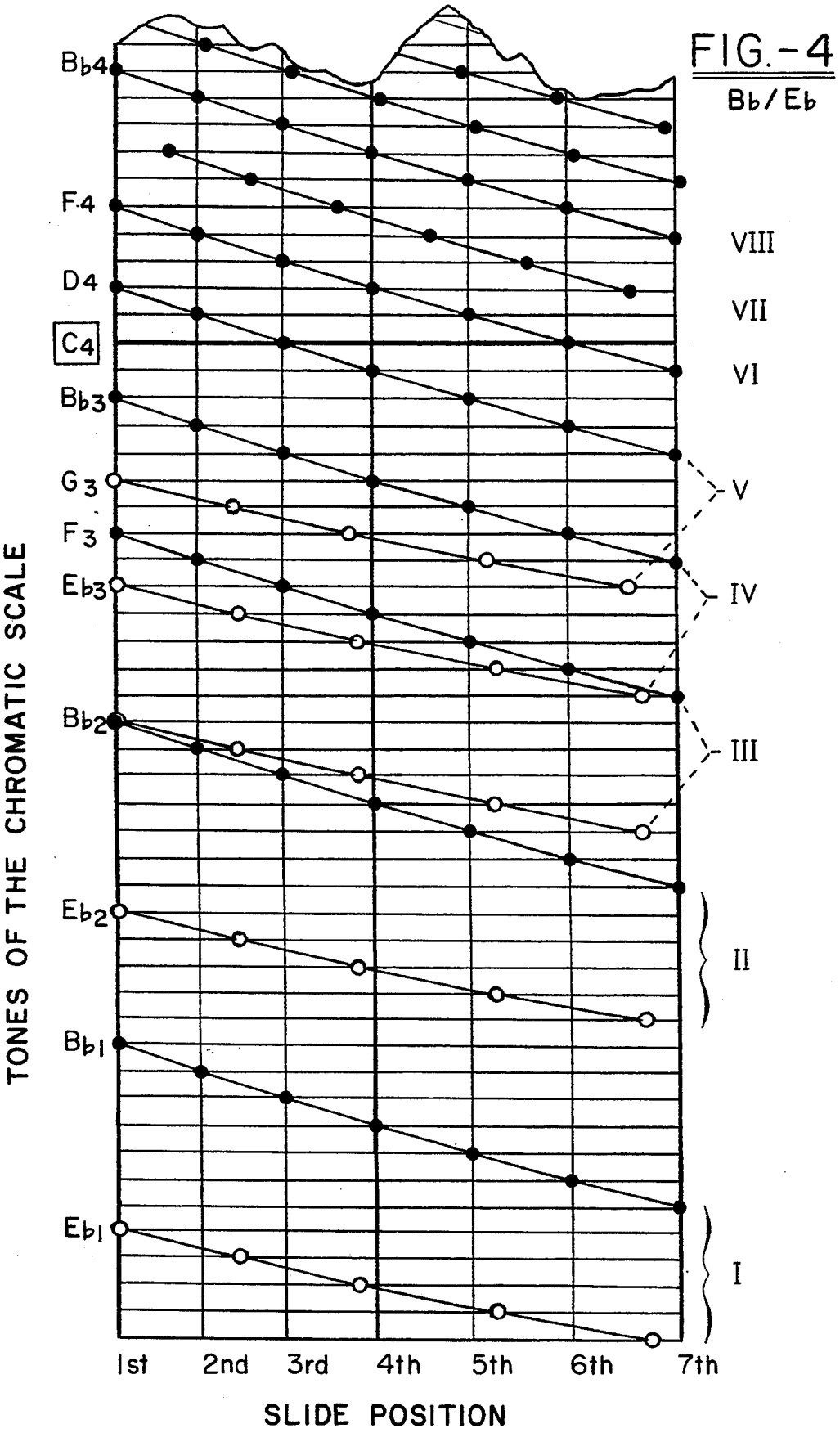
FIG. 4 is a tone/slide-position chart for a B♭/E♭ trombone in accordance with the present invention.

FIGS. 3 and 4 show charts of tone versus slide position for the present invention. The Y axis represents the closed position of the slide, and the points on that axis are tones which can be played on a trombone with the slide in a closed position. The horizontal lines represent notes of the chromatic scale.

The vertical lines represent relative slide positions for each embodiment of the instrument without the attachment activated, with the first position at the left, and the fourth position emphasized for reference. The distance between the successive slide positions increases toward the right according to a geometric progression. The solid dots represent all available positions for the indicated tones without the attachment activated. Open circles show attachment notes. Notes belonging to any given "harmonic" designated by a Roman numeral, are joined by sloping lines. Because of non-uniform compression of harmonic series, many of the upper register's tones do not occur at exactly standard position locations. For example, the seventh, eleventh, and some other higher harmonics are displaced.

The trombone of the present invention includes a tuning attachment 34, consisting of an assembly including a valve 36, and an attachment tuning loop 38. The valve can be a standard valve as is known in the art, such as a rotary valve (i.e., conventional or Yamaha three port) or a Thayer axial valve, and the tuning loop will be configured accordingly to accommodate the wind passage coming out of and into the valve. The valve is a thumb actuated valve such as by a thumb trigger 40. The trigger may be positioned so that it activates either the basic windpath or the attachment. Various trigger mechanisms which are suitable are well known in the art.

The configuration of the attachment lowers the basic pitch by a perfect fifth, i.e., seven complete semitones. Examples of suitable pitch combinations include B♭/E♭ and C/F, with the first tone indicating the basic pitch of the instrument with the slide in first position and the second tone indicating the basic pitch of the instrument with the attachment activated and the slide in the first position. The present invention is most applicable for large bore bass trombones.

As can be seen in FIG. 3 representing the tone chart for the $B_2$♭/F perfect fourth attachment trombone of the prior art, this configuration lacks a low B# (i.e., the five-note gap between the conventional and pedal tones of the instrument without attachment is not completely filled by using the perfect fourth attachment). By contrast, FIG. 4 shows that the perfect fifth attachment exactly fills the five-note gap by providing a complete chromatic range within the same slide length. By "complete chromatic range" as used herein, it is meant that the player can play all notes of any pitch between the pedal tones and the conventional tones using a conventional length slide. Moreover, no special additional attachment or second trigger or reconfiguration of tuning slides are necessary to achieve this.

While in accordance with the Patent Statutes, the best mode and preferred embodiment has been set forth, the scope of the invention is not limited thereto, but rather by the scope of the attached claims.

What is claimed is:

1. A slide trombone having a basic windpath comprising:

a mouthpiece, a slide assembly, a tuning loop, and a bell, said slide trombone having an activatable attachment which lengthens the basic windpath to define a lengthened windpath when activated, said slide assembly including a slide which is outwardly positionable from a closed position to lower the pitch of the basic windpath by up to six complete semitones when the attachment is not activated and whereby the attachment is activated to lower the pitch of the basic windpath by a perfect fifth when the slide is in the closed position.

2. A slide trombone according to claim 1, wherein the basic pitch of the basic windpath is either B♭ or C.

3. A slide trombone according to claim 2, wherein the attachment is activated by a trigger which is a thumb actuated trigger.

4. A slide trombone according to claim 3, wherein the thumb actuated trigger is actuated to lower the pitch of the windpath from B♭ to E♭.

5. A slide trombone according to claim 3, wherein the basic pitch of the basic windpath is B♭, the trigger is actuated to raise the pitch of the windpath from E♭ to B♭.

6. A slide trombone according to claim 4, wherein the slide has seven positions in the B♭ tuning and five positions in the E♭ tuning.

7. A slide trombone according to claim 5, wherein the slide has five positions in the E♭ tuning and seven positions in the B♭ tuning.

8. A slide trombone according to claim 3, wherein the thumb actuated trigger is actuated to lower the pitch of the windpath from C to F.

9. A slide trombone according to claim 3, wherein the basic pitch of the basic windpath is c the trigger is actuated to raise the pitch of the windpath from F to C.

10. A slide trombone according to claim 8, wherein the slide has seven positions in the C tuning and five positions in the F tuning.

11. A slide trombone according to claim 9, wherein the slide has five positions in the F tuning and seven positions in the C tuning.

12. A slide trombone having a basic windpath comprising:

a mouthpiece, a slide assembly, a tuning loop, and a bell, said slide trombone having an activatable attachment which lengthens the basic windpath to define a lengthened windpath when activated, said slide assembly including a slide which is outwardly positionable from a closed position to lower the pitch of the basic windpath by up to six complete semitones when the attachment is not activated and whereby the pitch of the basic windpath is B♭ and the pitch of the attachment is E♭.

13. A slide trombone having a basic windpath comprising:

a mouthpiece, a slide assembly, a tuning loop, and a bell, said slide trombone having an activatable attachment which lengthens the basic windpath to define a lengthened windpath when activated, said slide assembly including a slide which is outwardly positionable from a closed position to lower the pitch of the basic windpath by up to six complete semitones when the attachment is not activated and whereby the pitch of the basic windpath is C and the pitch of the attachment is F.

* * * * *

UNITED STATES PATENT AND TRADEMARK OFFICE

CERTIFICATE OF CORRECTION

PATENT NO. : 5,375,499

DATED : December 27, 1994

INVENTOR(S) : B. P. Leonard

It is certified that error appears in the above-indentified patent and that said Letters Patent is hereby corrected as shown below:

On the title page, item [54] and column 1, lines 2-3, the title should read --SINGLE-TRIGGER, PERFECT FIFTH SLIDE BASS TROMBONE--

Signed and Sealed this

Twenty-first Day of March, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,375,499

DATED : December 27, 1994

INVENTOR(S) : B. P. Leonard

It is certified that error appears in the above-indentified patent and that said Letters Patent is hereby corrected as shown below:

Please correct the patent by deleting at every occurrence the "♯" symbol and substituting therefor the --♮-- symbol.

Signed and Sealed this

Seventh Day of November, 1995

*Attest:*

*Attesting Officer*

BRUCE LEHMAN

*Commissioner of Patents and Trademarks*